US006216596B1

(12) United States Patent
Wesson

(10) Patent No.: US 6,216,596 B1
(45) Date of Patent: Apr. 17, 2001

(54) ZINC ALLOY SHAPED CHARGE

(75) Inventor: David S. Wesson, DeSoto, TX (US)

(73) Assignee: Owen Oil Tools, Inc., Fort Worth, TX (US)

( * ) Notice: Subject to any disclaimer, the term of this patent is extended or adjusted under 35 U.S.C. 154(b) by 0 days.

(21) Appl. No.: 09/222,442

(22) Filed: Dec. 29, 1998

(51) Int. Cl.[7] ..... F42B 1/02; F42B 3/00

(52) U.S. Cl. ..... 102/312; 102/307; 102/310; 102/313; 102/506; 102/517

(58) Field of Search ..... 102/306, 307, 102/312, 313, 506, 517, 310

(56) References Cited

U.S. PATENT DOCUMENTS

| | | | | |
|---|---|---|---|---|
| 4,875,413 | * | 10/1989 | Christopher et al. | 102/312 X |
| 4,885,993 | * | 12/1989 | Hancock et al. | 102/307 |
| 4,922,825 | | 5/1990 | Aubry et al. | 102/476 |
| 4,958,569 | | 9/1990 | Mandigo | 102/476 |
| 4,990,310 | | 2/1991 | Rashid et al. | 420/514 |
| 5,078,054 | * | 1/1992 | Ashok et al. | 102/506 X |
| 5,098,487 | | 3/1992 | Brauer et al. | 148/432 |
| 5,509,728 | | 4/1996 | Hanna et al. | 303/115.2 |
| 5,648,635 | * | 7/1997 | Lussier et al. | 102/307 |
| 5,656,791 | | 8/1997 | Reese et al. | 102/307 |
| 5,679,920 | * | 10/1997 | Hallis et al. | 102/506 |
| 5,963,776 | * | 10/1999 | Lowden et al. | 102/506 X |

FOREIGN PATENT DOCUMENTS

| | | | | |
|---|---|---|---|---|
| WO 96/23193 | * | 8/1996 | (WO) | 102/506 |

* cited by examiner

*Primary Examiner*—Peter A. Nelson
(74) *Attorney, Agent, or Firm*—Charles D. Gunter, Jr.

(57) ABSTRACT

A shaped charge is shown with enhanced creep resistance for use in a perforating gun having an elongated spiral strip open to the wellbore through which the charges are attached. The shaped charge is a hollow bodied capsule and hollow bodied cap, both threaded for easy attachment to one another. At least the capsule consists of an alloy of, by weight, between about 4 and 12 percent copper, 2 and 4 percent aluminum, and the balance zinc and impurities.

4 Claims, 1 Drawing Sheet

ZINC ALLOY SHAPED CHARGE

BACKGROUND OF THE INVENTION

1. Field of the Invention

This application relates to strip perforating systems using a plurality of shaped charges in a wellbore to form perforations through which water, petroleum or minerals are produced, and in particular, the incorporation of shaped charges composed of an improved zinc alloy to improve creep resistance into the perforating system.

2. Description of the Prior Art

This invention is an improvement of the prior art of shaped explosive charges. The conventional zinc alloy that is used to manufacture standard oil field shaped charges is Alloy ZA-5. There have been few improvements on the material used to manufacture the casing of the shaped charges. This is largely due to the use of shaped charges that are encased in metal piping as it is lowered into the wellbore, thus protecting the charge from the harsh wellbore environment. However, due to the advantages of using capsule-exposed shaped charges, there is a need for an improved material for manufacturing the casing or capsule.

Other shaped charges employing various metal alloys are disclosed. For example, Aubry et al. (U.S. Pat. No. 4,922,825); Brauer et al. (U.S. Pat. No. 5,098,487); Mandigo (U.S. Pat. No. 4,958,569); Reese et al. (U.S. Pat. No. 5,656,791). In these inventions, the unique features disclosed are various compositions in specific parts of the shaped charge. In Aubry et al., the invention is an explosive charge incorporating a "coating" that acts as a projectile upon explosion of the charge. In Brauer et al., the invention is a metal liner which covers the open face of the explosive material and creates a perforation that does not leave behind a metal slug which can impede the flow of oil. In Mandigo, the invention is a metal liner as in Brauer et al., but using a wrought copper alloy. Finally, Reese et al. discloses an invention of a liner for a shaped charge made of a mixture of tungsten and powdered metal binder instead of copper as in previous disclosures. None of these prior art inventions use any unique mixture of metals or alloy compositions for the casing material. These prior art references are primarily directed toward the liners used in the shaped charges under consideration.

The conventional ZA-5 zinc alloy exhibits many properties that makes it a good choice for die casting charge cases. These properties include: (a) easily die-formed into shaped charge cases, (b) material vaporizes upon detonation of the charge, (c) high density material maintains the shaped charge performance, (d) acid soluble material, (e) inexpensive materials, (f) little machine work needed before loading charge, and (g) low cost process to manufacture the case. In any new material used to make shaped charges it would be desirable to maintain these properties.

There are, however, two important drawbacks to the conventional zinc alloy shaped charges: low yield strength, and low creep resistance. The low yield strength equates to lower performance shaped charges and low pressure resistance for capsule-exposed charges such as the charges in Shirley et al. (U.S. Pat. No. 5,638,901). Further, creep resistant qualities are important in perforating guns where the shaped charges are exposed to extreme pressures during placement in the wellbore. Thus, it is important to have a high creep resistance in the charge for maximum performance.

Further, the low creep resistance of the conventional materials causes poor performance of the shaped charges when used as exposed-capsule charges. When the case material creeps (moves) under stress, as when being lowered into the wellbore, the charge liner and explosive load relaxes and moves from its proper position. This creates and unpredictable and uncontrollable pattern of perforations within the formation surrounding the wellbore.

The only alternative inexpensive die material that currently works for exposed-shaped charges as in Shirley et al. is certain aluminum alloys. However, these have many disadvantages such as (a) requiring more expensive cold chamber process in its formation, (b) low density aluminum is inferior to high density zinc alloy, (c) a high temperature of vaporization which will not allow the casing of the shaped charge to disintegrate when the charge detonates, and (d) the aluminum alloys have a lower acid solubility.

The present invention is an improvement to zinc alloy shaped charges that solves the above mentioned problems with Zinc Alloy Z-5 and other aluminum alloys, while maintaining the beneficial properties of the Z-5 alloy. The new shaped charge utilizes a zinc alloy with additional copper and aluminum known as ACuZinc. This material is discussed in certain prior art references such as Rashid et al. (U.S. Pat. No. 4,990,310), and Hanna et al. (U.S. Pat. No. 5,509,728) for use in diverse environments, such as that of a brake system. The invention described in those patents is assigned to General Motors Corporation, and they own the trademarked name ACUZINC as well.

The ACuZinc alloy was designed primarily for use as a creep-resistant alloy in automobile brakes. The physical properties of the alloy were desirable for withstanding the high forces and temperatures that are generated in the gear mechanisms of anti-lock braking systems. A use in an explosive device where the alloy disintegrates was not disclosed nor envisioned.

The ACuZinc alloy has the advantage of being easy and inexpensive to manufacture. ACuZinc alloy can be formed by traditional die casting operation. Typically, molten metal is injected at high pressure into a fixed-volume cavity defining the shape of the product desired. The cavity typically has a water-cooling jacket to cool the casted product. The molten metal is injected into the cavity by a shot apparatus comprising a sleeve for receiving a charge of the molten metal and a plunger that advances within the sleeve to force the molten metal into the cavity.

Two types of casting apparatus exist. In a hot chamber apparatus, a shot sleeve is immersed in a bath of the molten metal. In a cold chamber apparatus, the molten charge is transferred into the shot apparatus from a remote holding furnace. Although shaped charges can be cast using both methods, the hot chamber method is preferred due to lower cost. Alloys that presently exist embodying the desired creep resistance must be made by the cold chamber method. The ACuZinc alloy has the advantage of being employable by both hot and cold chamber methods. Thus, using the ACuZinc alloy will lower the cost of shaped charges as well as increase the strength.

The proposed embodiment for the shaped charge would employ the ACuZinc alloy. The shaped charge is a typical Owen-capsule exposed charged like the Shogun NT charge as disclosed in Shirley et al. These capsules are unique from prior art (e.g., Aubry et al., U.S. Pat. No. 4922,825; Brauer et al., U.S. Pat. No. 5,098,487). Since the Owen-capsules are exposed to the wellbore environment when in use, they must be able to withstand extreme pressures and resistance while being lowered into the wellbore. The ACuZinc alloy is ideal for this application because of its high strength at high temperature, high creep resistance, acid solubility, ease of hot chamber die casting, low cost, and high density.

SUMMARY OF THE INVENTION

In accordance with a preferred embodiment, a die casting of the shaped charge of this invention is composed of an alloy consisting of that disclosed in Rashid et al. Specifically, the alloy consists essentially of, by weight, between 4 and 11 percent copper, between 2 and 4 percent aluminum, up to 0.05 percent magnesium and the balance zinc and impurities.

A preferred embodiment of the shaped charge consists of a hollow cap with a nose for attachment to one of the openings in a spiral strip with an outer surface diameter sized for convenient insertion and removal from a well. The cap has an annular, interior thread with a thread run-out of selected width. The explosive capsule has a hollow body having an open end with exterior threads and a width less than the width of the thread run-out in the cap to permit free spinning of the body in the cap after thread make-up for convenient threading and connection with the detonating cord. The closed end of the capsule has a slot and retainer to receive a detonating cord. The hollow body of the explosive capsule may be freely spun to align the slot and retainer for convenient threading and connection with the detonating cord.

Both the cap and capsule portions of the shaped charge are exposed to the wellbore, and, in particular, it is the capsule portion that must disintegrate upon detonation of the charge. Further, the cap and capsule portions of the charge are also exposed to high pressures within the wellbore in which creep resistance becomes a factor in the charge's performance. Hence, at least the capsule portion of the shaped charge is made of the ACuZinc alloy. The new charge will be an improvement from the prior art in allowing more predictability in forming perforations within the wellbore.

Additional objects, features and advantages will be apparent in the written description which follows.

DETAILED DESCRIPTION OF THE INVENTION

Figure 1:
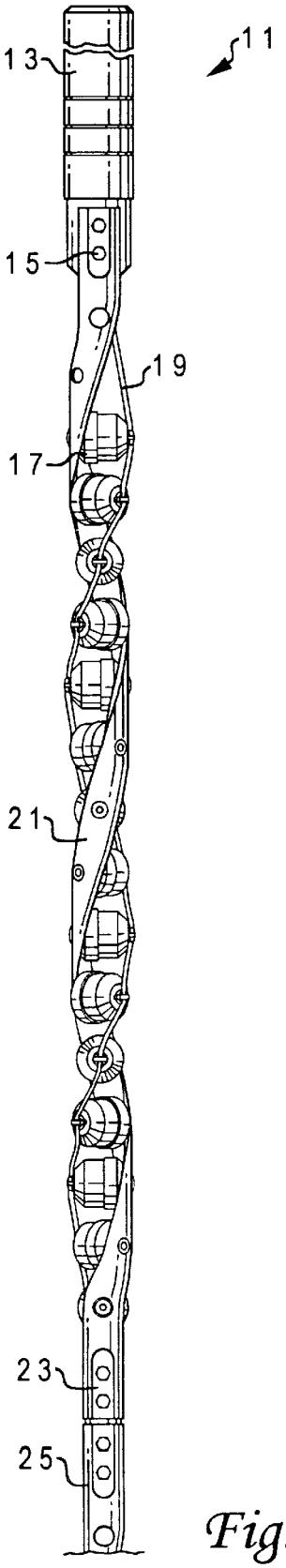
FIG. 1 shows a portion of the perforating gun that holds the shaped charges of the invention.

Referring to FIG. 1, the numeral 11 designates the perforating gun for well perforating having an elongated, spiraled strip 21, the strip having an outer diameter sized for convenient insertion and removal from a well that contains geological formations that are to be perforated to enhance the production of petroleum and other minerals.

The spiral strip 21 is manufactured by utilizing the capabilities of a multiple axes laser milling machine on drawn-over-mandrel (DOM) tubing as described in Shirley et al. The perforating gun 11 has at its upper end a connector 13 for mounting on a conveyance sub (not shown) to raise or lower and position the gun at the selected elevation in the well adjacent to the geological formation to be perforated. The strip 21 is connected at its lower end by connector 25 with a plurality of fasteners 15 that may be socket head set screws or the equivalent. Secured to the connector 13 is an electrical means (not shown) adapted to supply electrical energy to a detonating cord 19.

The exterior surface of the strip 21 is cylindrical about the longitudinal axis of the strip and is formed of a selected metal that forms a helical band. In the embodiment illustrated, the helical band has a pitch in a range of 12 to 24 inches. A suitable thickness for the strip is 0.125 of an inch and the circumferential width of 1.25 inches.

At the lower end of the strip is connected a strap 23 to which may be secured a second spiraled strip 25. There are a series of openings in the spiraled strip 21 to serve as mounts for a plurality of explosive shaped charges 17. These openings are spaced in intervals along the length of the spiral strip so that they are arranged in a phase relationship to correspond with the selected perforation pattern in the well.

Figure 3:
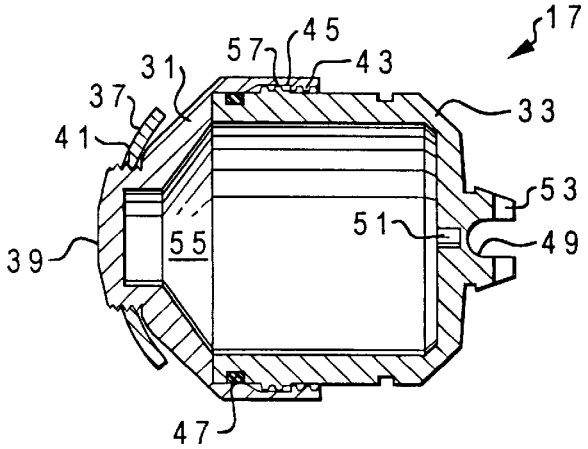
FIG. 3 illustrates one shaped charge of the type used in the preferred embodiment of the invention.

As shown in FIG. 3, each of the explosive shaped charges 17 has a cap 31 having a threaded nose 39 that engages the threads 41 of strip 21. The cross-sectional area of the strip around or adjacent each opening is selected to prevent fragmentation of the strip 21 upon detonation of the charge, taking into account the strength of the material used to form the strip, which in the preferred embodiment is a strong, ductal and flexible material such as 1018 steel. The cap 31 is hollow with an interior cavity 55 to receive an explosive charge and terminate in an angular interior thread 43 having a thread runout 45.

Figure 2:
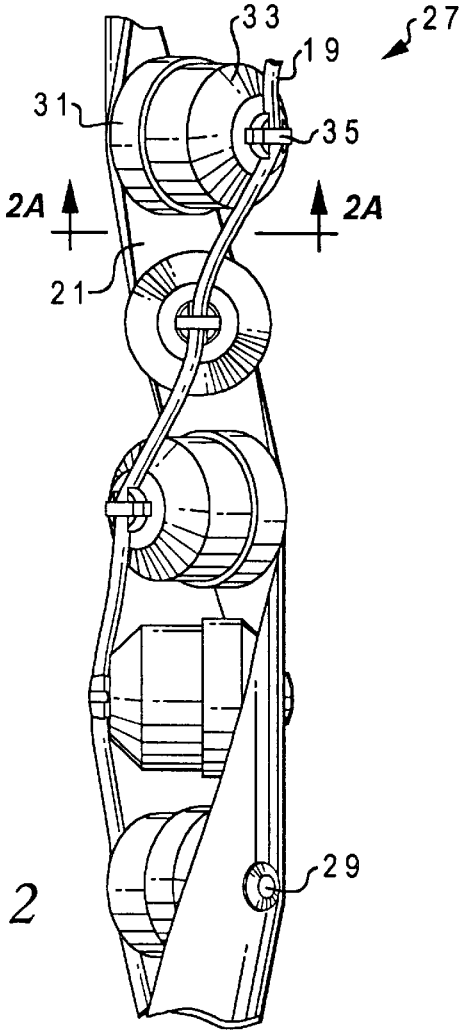
FIG. 2 is a fragmentary, enlarged view of the perforating gun to illustrate the mounting means and strip configuration.

The thread runout 45 is wider than the threads 57 that are formed on the exterior of the open end of a hollow bodied capsule 33 that partially contains the previously described explosive charge. The open end of the hollow body also has a seal 47 in an annular groove to prevent contamination and degradation of the explosive charge. The opposite end of the capsule 33 has a slot 49 to receive the detonating cord 19 shown in FIGS. 1 and 2. The slot 49 is adjacent a heat-sensitive firing pin 51 that will detonate the explosive inside the capsule. A slot 53 receives a retainer clip 35 (FIG. 2) of conventional configuration to secure the detonating cord in its position adjacent to firing pin 51.

At least the capsule is made of the ACuZinc alloy. In a particularly preferred embodiment, the alloy comprises 10.0 weight percent copper, 3.6 percent aluminum, 0.03 percent magnesium, and the balance zinc and impurities. The molten material is die cast by pouring at a temperature of about 532° C. into the shot sleeve. Within the die, the alloy cools and solidifies. After cooling, the die sections are parted to eject a product casting.

The casting of capsule 33 is formed under conditions that include rapid solidification. This is accomplished by encasing the forming cast in a cooling die and intensification pressure applied by the injection apparatus. By rapidly cooling the die, the melt forms a grain structure that is compatible with the high creep strength of the ACuZinc alloy. The ACuZinc alloy can be cast using either hot or cold die casting. For hot chamber die casting, the alloy is preferably cast at a temperature between about 410° C. and 490° C. and injected at a pressure between about 1500 MPa and 4500 MPa. Cold chamber die casting is preferably carried out at a temperature between about 480° C. and 650° C. and an injection pressure between about 4500 MPa and 10,000 MPa.

The properties of the casting are tested using ASTM test methods. Specifically, the Birnell hardness of the casting is 146. Less than 2 percent creep was found after subjecting a sample to a tensile stress of 40 MPa at 150° C. for 70 hours. This is a dramatic improvement over conventional alloys comprising, for example, 3.8 percent aluminum, 0.031 percent magnesium, and the balance zinc and impurities. The conventional alloy of this latter composition exhibited a creep strain of 4 percent in only 1–2 hours under identical conditions as the ACuZinc alloy test conditions.

The shaped charges of the invention preferably include at least a capsule formed from the alloy previously described. The capsule 33 can be made using a range of compositions. The copper can range in amounts between about 4 and 12 weight percent, aluminum in an amount between about 2 and 4 percent, magnesium in an amount between 0.025 and 0.05 percent, and the balance substantially zinc plus iron and other impurities typical in these metals. Alloys that contain less than 4 percent copper do not form a lattice structure consistent with a high creep resistance. On the other hand, alloys containing greater than 8 percent copper have elevated melting points which make it impractical for typical hot chamber die casting. But, for the cold chamber casting, a copper range between 9 and 11 percent is suitable.

The preferable range of aluminum in the alloy is between 2 and 4 percent. Enough aluminum is necessary to provide the desired fluidity for convenient handling in typical die casting apparatuses. But an aluminum content higher than 4 percent makes the casting product too brittle for the desired use. Finally, the presence of magnesium in a range of 0.025 and 0.05 weight percent is generally necessary to reduce stress corrosion cracking.

An invention has been provided with several advantages. The present invention is an improvement over the prior art of explosive shaped charges. This is especially the case for shaped charges to be used in conditions where the charge is exposed to the harsh conditions within a wellbore. The shaped charges can be used in the perforating gun invention described by Shirley et al. (U.S. Pat. No. 5,638,901). In that invention, the perforating gun has an elongated, spiral strip with an outer surface, cylindrical about a longitudinal axis, and a diameter sized for convenient entry and removal from a well. The strip has a series of threaded openings spaced in intervals for mounting the shaped charges in a phased relationship between 0 and 360 degrees. The cross-sectional area of the strip around each opening is selected to prevent fragmentation of the carrier upon detonation of the charges.

Such a design for a perforating gun is advantageous in that it allows a widely varied phasing of the charges while allowing for retrieval of the carrier. But in order for this spiral strip perforating gun to function under particularly demanding wellbore conditions, the shaped charges must have a large creep resistance since the charges are exposed to a high pressure, extreme environment in the wellbore.

By using the ACuZinc alloy, the shaped charges of this invention achieve the necessary specifications for use in the spiral strip perforating gun. The shaped charges of this invention maintain the benefits of the conventional alloys, namely, easily die formed, material vaporizes upon detonation, little machine work required, and the ability to use less expensive hot chamber process to manufacture. The ACuZinc alloy imparts a high creep resistance to the shaped charge that is desirable as an exposed-shaped charge.

While the invention has been shown in only one of its forms, it is not thus limited but is susceptible to various changes and modifications without departing from the spirit thereof.

What is claimed is:

1. A perforating gun carrying a plurality of shaped charges connected by a detonating cord to perforate a section of a well in a selected pattern, comprising:

an elongated support structure having an outer diameter sized for convenient entry and removal from a well;

a series of openings located at spaced intervals along a length of the support structure to serve as mounts for the shaped charge explosives to be arranged in an angular phase relationship to correspond with said selected perforation pattern in the well;

attachment means provided on an exterior surface of the shaped charges for attachment to mating attachment means provided in the support structure openings;

wherein the shaped charges have a body and a cap and wherein at least the body of the shaped charges comprises an alloy containing, by weight, between about 4 and 12 percent copper, 2 and 4 percent aluminum, and the balance zinc and impurities.

2. A perforating gun carrying a plurality of shaped charges which are explosively connected by a detonating cord to perforate a section of a well in a selected pattern, comprising:

an elongated, spiraled strip having an outer diameter sized for convenient entry and removal from a well;

a series of openings spaced in intervals along a length of the spiraled strip to serve as mounts for the shaped charge explosives to be arranged in an angular phase relationship to correspond with said selected perforation pattern in the well;

wherein the openings of the spiraled strip are threaded and the shaped charges are provided with caps that have exterior threads for engagement within the threaded openings of the spiral strip;

wherein the shaped charges are exposed to wellbore fluids as the strip is lowered into position within a wellbore and wherein the shaped charges each have charge bodies which are comprised of an alloy containing, by weight, between about 4 and 12 percent copper, and 4 percent aluminum, and the balance zinc and impurities.

3. The perforating gun of claim 2, wherein each shaped charge has a capsule body and wherein each capsule body has a closed end opposite the end which engages the cap, the closed end being provided with a slot and a retainer to receive a detonating cord.

4. The perforating gun of claim 2, wherein said shaped charges exhibit a creep strain of less than 2 percent at 150° while subjected to a 40 Mpa load.

* * * * *